United States Patent [19]

Kornbrekke et al.

[11] Patent Number: 4,565,029

[45] Date of Patent: Jan. 21, 1986

[54] TRAFFIC RESPONSIVE CONTROL SYSTEM FOR AUTOMATIC SWINGING DOOR

[75] Inventors: Henning N. Kornbrekke, Burlington; David M. Cirkot, Ansonia; Anthony R. Ranaudo, Naugatuck, all of Conn.

[73] Assignee: The Stanley Works, New Britain, Conn.

[21] Appl. No.: 555,565

[22] Filed: Nov. 28, 1983

[51] Int. Cl.[4] ..... E05F 15/20

[52] U.S. Cl. ..... 49/25; 49/28; 49/264; 250/221

[58] Field of Search ..... 49/25, 28, 30, 31, 264; 340/545, 546, 696, 825.72; 250/221, 222.1

[56] References Cited

U.S. PATENT DOCUMENTS

| | | | |
|---|---|---|---|
| 3,852,592 | 12/1974 | Scoville et al. | 250/221 |
| 3,857,466 | 12/1974 | Berkovitz et al. | 250/221 X |
| 4,272,921 | 6/1981 | Jorgensen | 49/31 X |
| 4,514,625 | 4/1985 | Heiland | 340/556 X |

*Primary Examiner*—Kenneth Downey

*Attorney, Agent, or Firm*—Prutzman, Kalb, Chilton & Alix

[57] ABSTRACT

An automatic door installation with four traffic sensors mounted on the door jambs on opposite sides of the doorway opening and having radiant energy emitters and reflected energy receivers for sensing doorway traffic. Two sensors are employed to cover the exit or swing side of the doorway, a threshold sensor is employed to cover the threshold area and an entrance sensor is employed to cover the entrance side of the doorway. The entrance and two exit sensors each have a plurality of radiant energy emitters with angularly spaced beam axes to provide broad coverage areas intersecting the traffic path of travel. The emitters of the exit and threshold sensors are selectively deactivated as the door is swung between its open and closed positions to avoid sensing the door. The emitters of all four sensors are pulsed in a predetermined sequence and the sensor receivers are timely activated to receive reflected radiant energy from the respective emitter(s) only.

27 Claims, 12 Drawing Figures

TRAFFIC RESPONSIVE CONTROL SYSTEM FOR AUTOMATIC SWINGING DOOR

BRIEF SUMMARY OF THE INVENTION

The present invention relates generally to traffic responsive control systems for automatic swinging doors and relates more particularly to a new and improved traffic responsive control system for sensing traffic passing through the swinging door and operable for opening the door and holding the door open until the traffic passes completely free of the door and/or operable for preventing or otherwise controlling the operation of the door to prevent abrupt engagement of the door with traffic in or adjacent to the path of travel of the door.

It is a primary aim of the present invention to provide a new and improved traffic responsive control system of the type described having a presence sensor system for sensing the presence of traffic at both the entrance and exit sides of the swinging door and which provides for automatically opening the door when there is traffic at the entrance side of the door and when there is no traffic within or adjacent to the path of travel of the swinging door.

It is another aim of the present invention to provide a new and improved traffic sensor system for an automatic swinging door which employs infrared energy transmission and reflected infrared energy receiving for sensing the presence of traffic at the entrance side of the door and/or within or adjacent to the path of travel of the swinging door at the exit side of the door. In accordance with the present invention, a traffic sensor system is provided which employs commercially available, infrared, light emitting diode (LED) emitters and photodiode receivers and which provides the desired coverage area without requiring optically focusing the emitted infrared energy or the receiver field of view.

It is a further aim of the present invention to provide a new and improved traffic sensor system for the safety or exit side of an automatic swinging door for sensing any traffic within or adjacent to the path of travel of the swinging door.

It is another aim of the present invention to provide a new and improved traffic sensor system for an automatic swinging door which provides for sensing the presence of traffic as the traffic approaches the doorway, passes through the doorway and until the traffic is completely free of the path of travel of the swinging door.

It is a further aim of the present invention to provide a new and improved traffic sensor system for the exit or safety side of an automatic swinging door and which is useful with both transparent and nontransparent doors and avoids sensing the door as it swings between its closed and open positions.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENTS

Figure 9A:
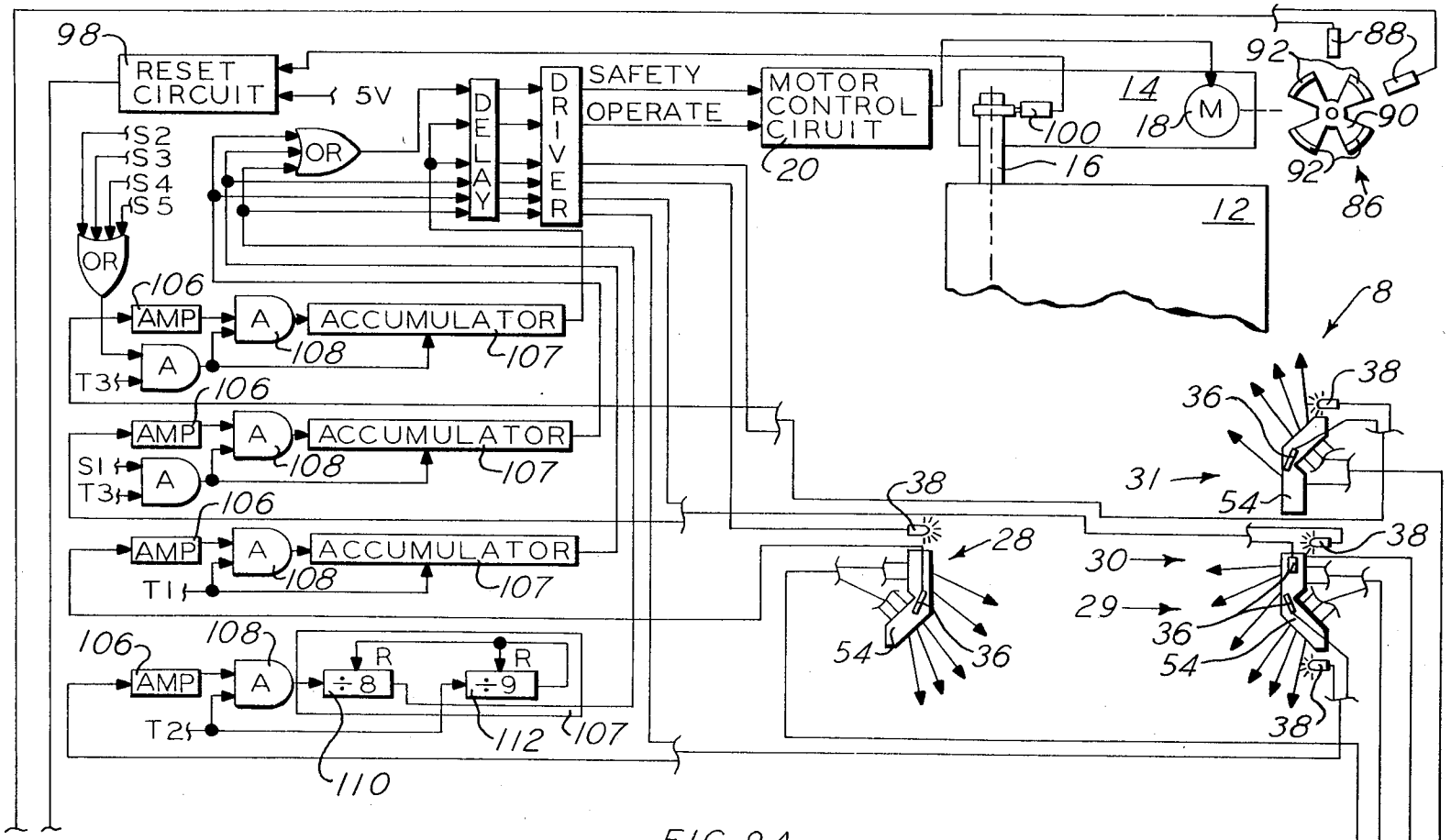
FIGS. 9A and 9B together provide a generally diagrammatic illustration of the automatic door installation, including a functional schematic illustration of the traffic responsive control system.

Referring now to the drawings in detail wherein like numerals designate the same or similar parts, an automatic door operator installation 8 incorporating an embodiment 10 of a traffic responsive control system of the present invention is shown employed with a pivotal or swinging door 12 having a header or internally mounted overhead power operator 14. Referring to FIG. 9A, the power operator 14 is shown directly connected to the door 12 via a vertical pivot or drive shaft 16 of the power operator 14. Except as described otherwise herein, the power operator 14 may for example be identical to the power operator disclosed in U.S. Pat. No. 4,220,051 of John C. Catlett, dated Sept. 2, 1980 and entitled "Electromechanical Door Operator" and U.S. Pat. No. 4,220,051 is therefore incorporated herein by reference. The power operator 14 has a suitable electric motor 18 for opening the door, 90 degrees in the clockwise direction as viewed in FIG. 4 from its closed position shown in FIG. 4. Also, the motor 18 is held energized, preferably at a lower power level than required for opening the door 12, to hold the door in its fully open position. As described in detail in U.S. Pat. No. 4,220,051, a spring operated mechanism (not shown) is employed for pivoting the door 12 to its closed position and the motor 18 is employed to brake the rate at which the door is closed.

A suitable motor control circuit 20 is provided for controlling the motor 18, and thereby control the opening and closing movement of the door 12, in response to "Operate" and "Safety" signals received from the traffic responsive control system 10. Briefly, an "Operate" signal is generated by the control system 10 to open the door as a pedestrian or other traffic approaches the entrance side of the door. A "Safety" signal is generated by the control system 10 as the pedestrian, etc. passes across the door threshold and through the doorway and until after the pedestrian, etc. is completely clear of the path of travel of the door 12. The "Operate" signal provides for opening the door and the "Safety" signal provides for holding the door open until the pedestrian, etc. is clear. A slight delay of for example one-half second is then provided before the power operator 14 is operated to close the door.

A "Safety" signal is also generated by a pedestrian or other traffic or object in the safety area on the exit side of the door when the door is closed. In that case, the "Safety" signal in effect will override an "Operate" signal to prevent the door 12 from opening.

In addition, as the door 12 is opened, a "Safety" signal is generated by the traffic responsive control system 10 when a pedestrian or other traffic or an object is sensed within or adjacent to the path of travel of the door 12 on the back side of the door. Although in the shown embodiment the door is quickly and fully opened when an "Operate" signal is generated (and when an overriding "Safety" signal is not generated on or before the "Operate" signal), if desired the traffic responsive control system 10 and the motor control system 20 may be suitably modified for stalling the partly open door 12 or in the alternative for slowly opening or slowly closing the door from its partly open position when a "Safety" signal is generated by traffic or an object on the back side of the door.

Thus, the "Operate" and "Safety" signals generated by the traffic sensor system may be employed to control the operation of the door in the same way as the "Operate" and "Safety" signals generated by prior conventional mat switches (not shown) provided on the entrance and exit sides of the doorway opening. Therefore, the motor control circuit 20 is not shown and described in detail.

The traffic responsive control system 10 comprises four separate presence sensors 28–31, each positioned and operated to cover a specific control area spanning the path of travel of traffic passing through the doorway. The four sensors 28–31 collectively cover approximately the same area as conventional entrance and exit mat switches (not shown) and in general cover a rectangular area extending up to four to six feet in each direction from the doorway opening and having a width about five inches greater in each direction than the doorway opening. Each sensor 28–31 comprises one or more LED infrared emitters or transmitters 34, a photodiode receiver 36 for receiving infrared energy transmitted by the transmitter(s) 34 of the corresponding sensor and reflected from a pedestrian or other traffic or an object within the control zone covered by the sensor, and an LED indicator light 38 provided to indicate that the sensor has sensed the presence of an object or traffic in its coverage zone.

Figure 4:
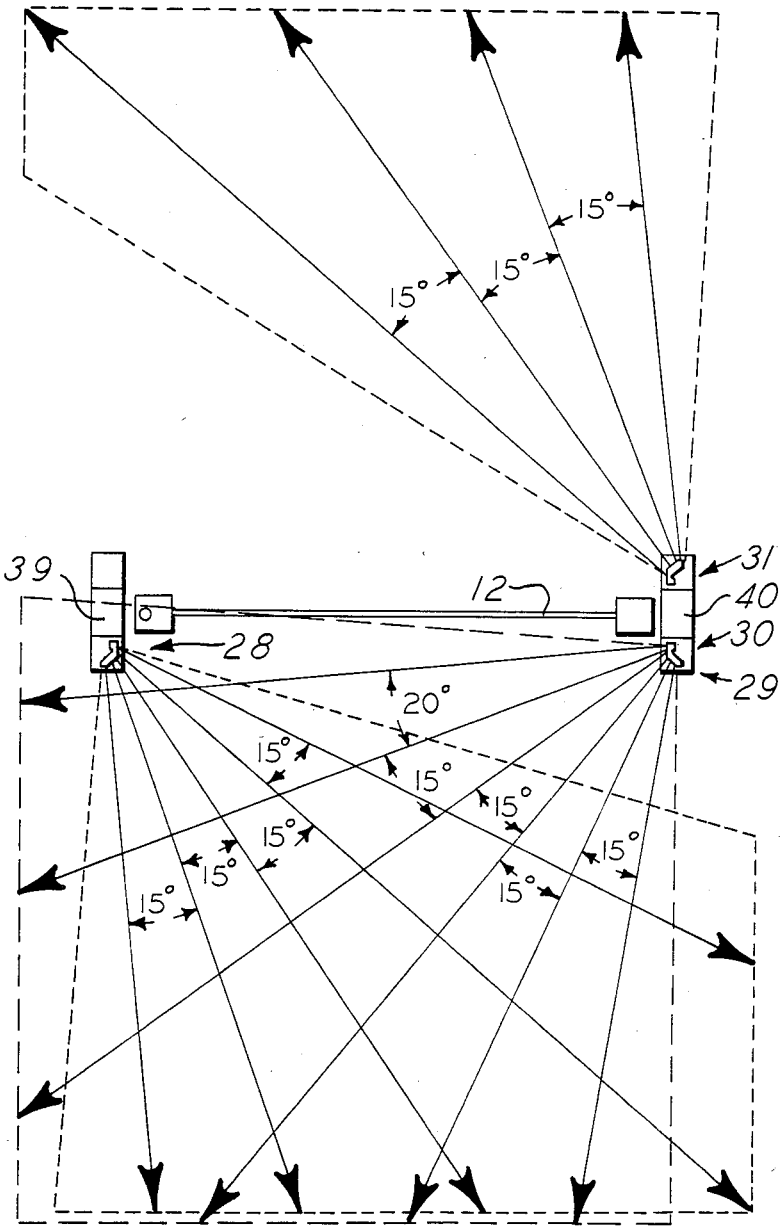
FIG. 4 is a generally diagrammatic top plan view of the door installation showing the beam axes of the infrared energy beams emitted by the infrared emitters of the traffic responsive control system.
Figure 6:
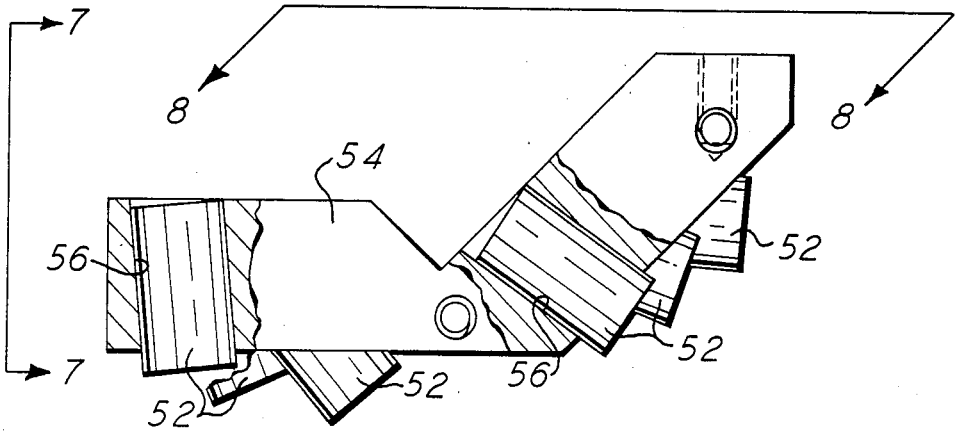
FIG. 6 is a plan section view, partly broken away and partly in section, of the emitter subassembly taken generally along the line 6—6 of FIG. 5.

The four sensors 28–31 comprise an operate sensor 31 which covers the entrance area on the entrance side of the doorway opening, a threshold sensor 30 which covers the threshold of the doorway opening and two safety sensors 28, 29 which cover the safety or exit area on the exit side of the doorway opening. One of the safety sensors 28 is mounted on the doorjamb 39 adjacent to the pivot axis of the door 12 (and therefore is referred to herein as the pivot safety sensor) and the other safety sensor 29 is mounted on the doorjamb 40 adjacent to the leading or free edge of the door (and therefore is referred to herein as the leading edge safety sensor). The threshold and operate sensors 30, 31 are also mounted on the leading edge doorjamb 40. The three sensors 29–31 provided on the leading edge doorjamb 40 may be mounted in two separate housings 42 on opposite sides of the inner sealing edge of the doorjamb 40 as shown in FIG. 4 or provided as a combined unit within the leading edge doorjamb 40. Similarly, in the illustrated embodiment, the pivot safety sensor 28 may be mounted on either the exit side of the pivot doorjamb 39 or within the pivot doorjamb 39. Where the sensors 29–31 are mounted on the sides of the doorjambs 39, 40, the threshold sensor 30 and the leading edge safety sensor 29 are provided in a single housing 44, and three separate housings 44 are employed which are preferably the same or mirror duplicates for economy of manufacture. With the sensors 28–31 mounted either within or on the sides of the doorjambs 39, 40, the sensors have suitable relatively broad band, filters 46, 48 to block out most of the ambient radiant energy which might otherwise be received by the receivers 36.

Figure 11:
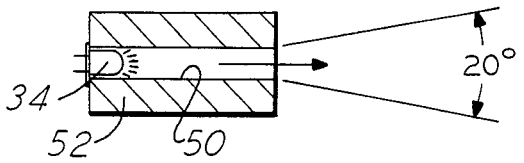
FIG. 11 is an enlarged longitudinal section view, partly in section, of an LED transmitter module of the traffic responsive control system.

Referring to FIG. 11, each LED transmitter 34 is mounted within a central cylindrical opening or bore 50 in an elongated tubular sleeve or bushing 52 so that the emitted radiant infrared energy (e.g. having a wavelength of 880 nanometers in the near infrared band) from the LED transmitter 34 is transmitted through a relatively long cylindrical tunnel (e.g. 0.64 inches) which limits the divergence of the transmitted infrared beam to approximately 20 degrees. The axis or centerline of each LED transmitter beam is illustrated in FIG. 4, and as shown, the axes of the LED transmitter beams of the pivot and leading edge safety sensors 28, 29 and the operate sensor 31 are spaced 15 degrees apart and so that the 20 degree beam coverage areas of adjacent beams overlap slightly. The infrared receivers 36 (FIG. 9A) are mounted directly above the corresponding transmitter(s) 34 to face in the direction of the centerline of the coverage area of the corresponding transmitter(s) 34 and have a wide, unfocused field of view to receive reflected infrared energy from the entire area covered by the corresponding transmitter(s) 34.

As is explained more fully hereinafter, the fifteen transmitters 34 of the four sensors 28–31 are pulsed or energized in sequence and each receiver 36 is connected to be activated only when the transmitter(s) 34 of the corresponding sensor 28–31 are being pulsed. Also, as hereinafter described, the transmitter/receiver pulse frequency is modulated to encode the entire sensor system and such that for example the sensor system of adjacent or nearby automatic doors can be encoded differently to avoid any cross interference between the sensor systems.

The horizontal area covered by each sensor 28–31 is shown in FIG. 4. The operate sensor 31 has four transmitters 34 which cover an angle of coverage of approximately 65 degrees extending from an angle of approximately 30 degrees from a plane parallel to the closed door 12 to approximately 5 degrees beyond a plane perpendicular thereto. The operate sensor coverage area spans the entrance path of travel leading to the door 12 and will sense the presence of a pedestrian or other traffic anywhere within a generally rectangular entrance area. The threshold sensor 30 has one transmitter 34 with a beam axis extending at an angle of approximately 5 degrees from the plane of the closed door 12 and provides angle of coverage of approximately 20 degrees which extends from the threshold transmitter 34 across the door threshold to the entrance side of the door opening. Accordingly, the threshold sensor 30 is capable of sensing the presence of a pedestrian or other traffic at or adjacent to the threshold of the door 12.

The pivot and leading edge safety sensors 28, 29 cover the safety side of the doorway, including behind and adjacent to the path of travel of the door as the door 12 pivots outwardly to its fully open position. The pivot safety sensor 28 covers the area behind the door 12 when it is fully closed and as the door opens. The leading edge safety sensor 29 covers the safety area behind the door 12 when the door is fully closed and also the area in front of the door when the door is fully open. Each safety sensor 28, 29 has five transmitters 34 and covers an angle of approximately 80 degrees, from an angle of approximately 15 degrees from a plane parallel to the plane of the closed door 12 to approximately 5 degrees beyond a plane perpendicular thereto.

Figure 5:
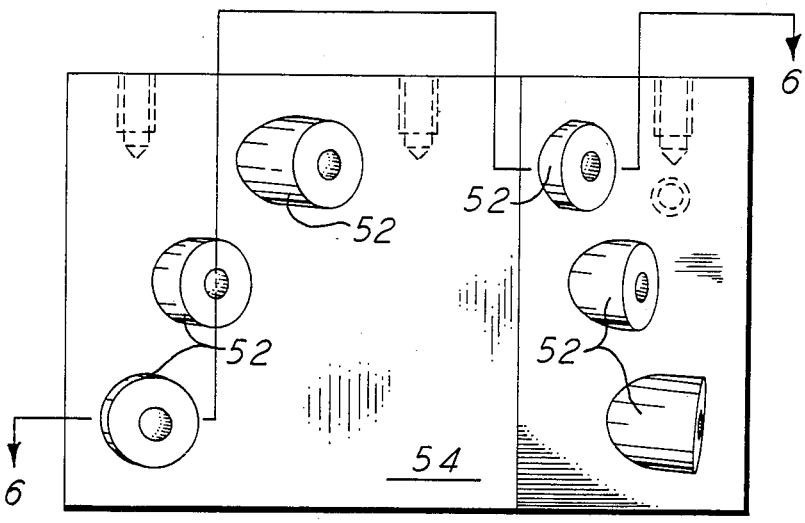
FIG. 5 is an enlarged front elevation view of a subassembly of threshold and leading edge safety sensor emitters of the traffic control system.
Figure 7:
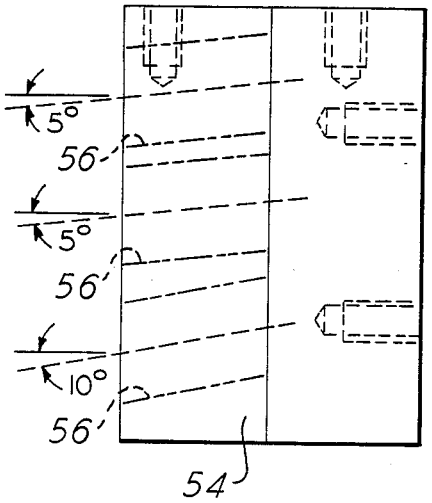
FIG. 7 is an elevation view of a mounting block of the emitter subassembly taken generally from the line 7—7 of FIG. 6.
Figure 8:
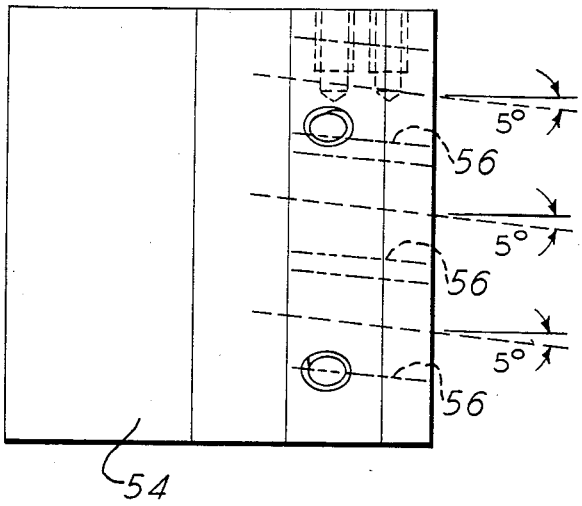
FIG. 8 is an elevation view of the mounting block taken generally from the line 8—8 of FIG. 6.

Referring to FIGS. 5–8, L-shaped mounting blocks 54 are provided for mounting the transmitter support bushings 52 for establishing the LED beam axis orientation. For economy of manufacture, the transmitter mounting blocks 54 used for the operate sensor 31 and the pivot safety sensor 28 are identical and the single transmitter mounting block 54 used for both the threshold sensor 30 and the leading edge safety sensor 29 is a mirror duplicate of those mounting blocks. Accordingly, when the door 12 is mounted to swing in the opposite direction, the mounting block 54 shown used for the operate and pivot safety sensors 31, 28 is used for the threshold and leading edge safety sensors 30, 29 and vice versa. Accordingly, each L-shaped mounting block 54 has six cylindrical support openings or bores 56 which are relatively oriented in accordance with the described LED beam axis orientation. Also, the support bores 56 are positioned relatively close together and so that the intersections or crossing points of the transmission beam axes of each mounting block 54 are relatively close together and the beams can be considered to emanate from a single point. For that purpose and because of their varying angular orientation, the LED support bushings 52 are mounted in a generally V-shaped (inverted) array as shown in FIG. 5.

Figure 10:
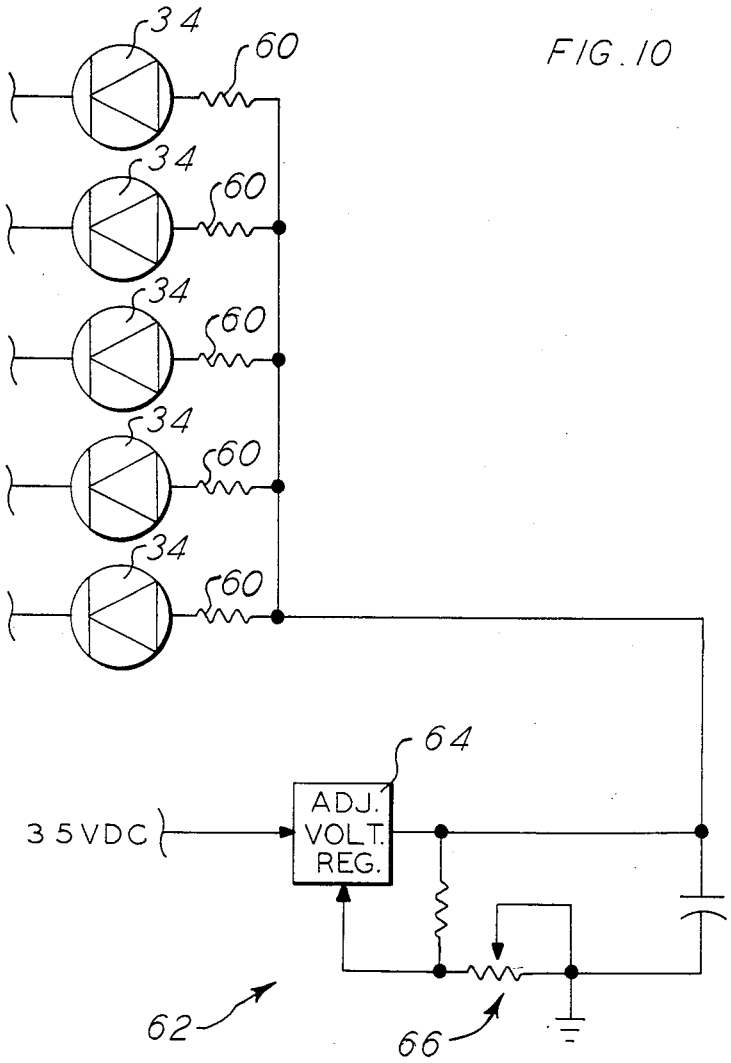
FIG. 10 is a schematic illustration showing a power supply circuit for the infrared emitters of a pivot safety sensor of the traffic responsive control system.

The transmitter(s) 34 of each sensor 28–31 are connected to a separate power supply circuit 62 as illustrated in FIG. 10 with the bank of five transmitters 34 of the pivot safety sensor 28. A separate resistor 60 is provided for each LED transmitter 34, mounted in series with the transmitter 34 between the transmitter 34 and its power supply circuit 62. The resistance values of the resistors 60 of each sensor 28, 29, 31 vary in accordance with the desired relative ranges of the sensor transmitters 34. Accordingly, the resistance of each transmitter resistor 60 is established at the time of manufacture to provide the desired relative transmitter range. On installation, an adjustable voltage regulator 64 of the power supply circuit 62 is adjusted with a variable resistor 66 to adjust the applied voltage and thereby fine tune the range and coverage area of the sensor.

Figure 1:
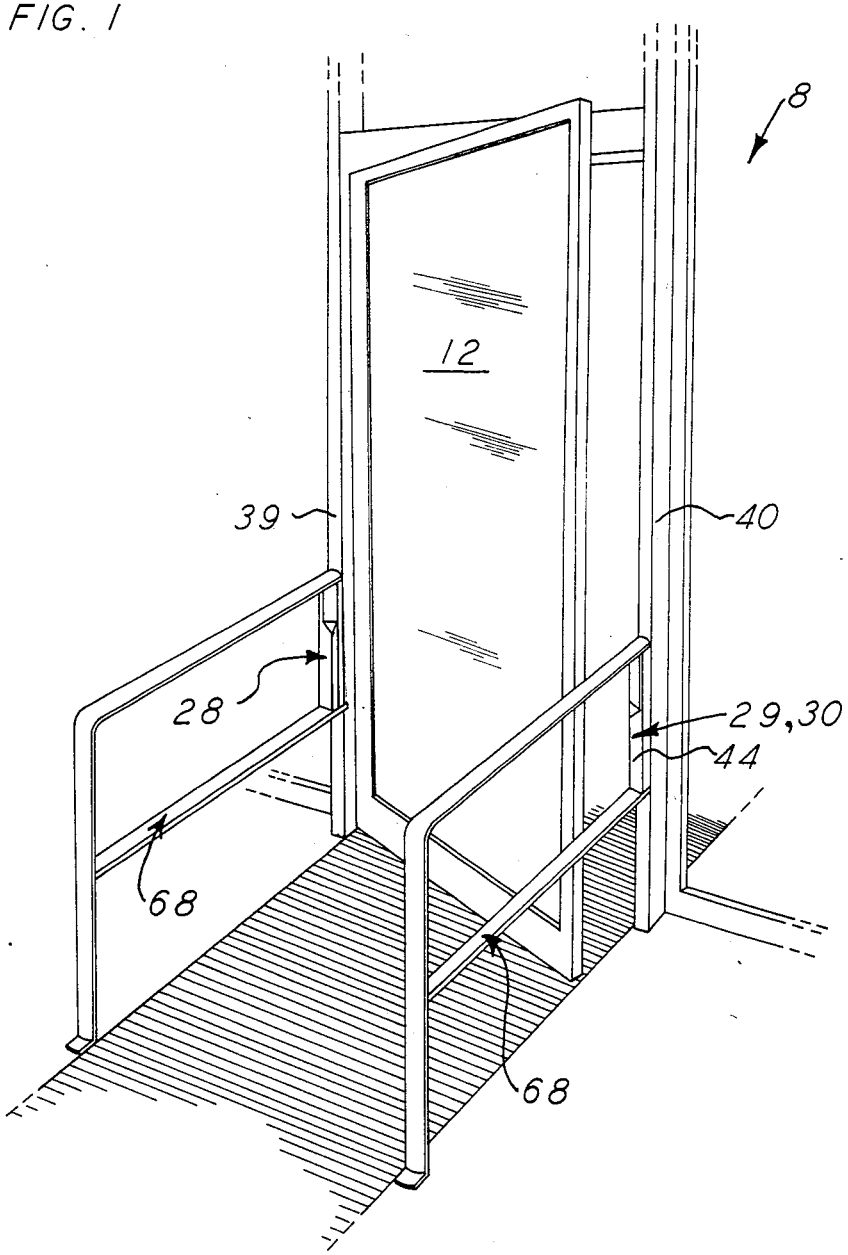
FIG. 1 is perspective view, partly broken away, of an automatic door installation incorporating an embodiment of a traffic responsive control system of the present invention.
Figure 2:
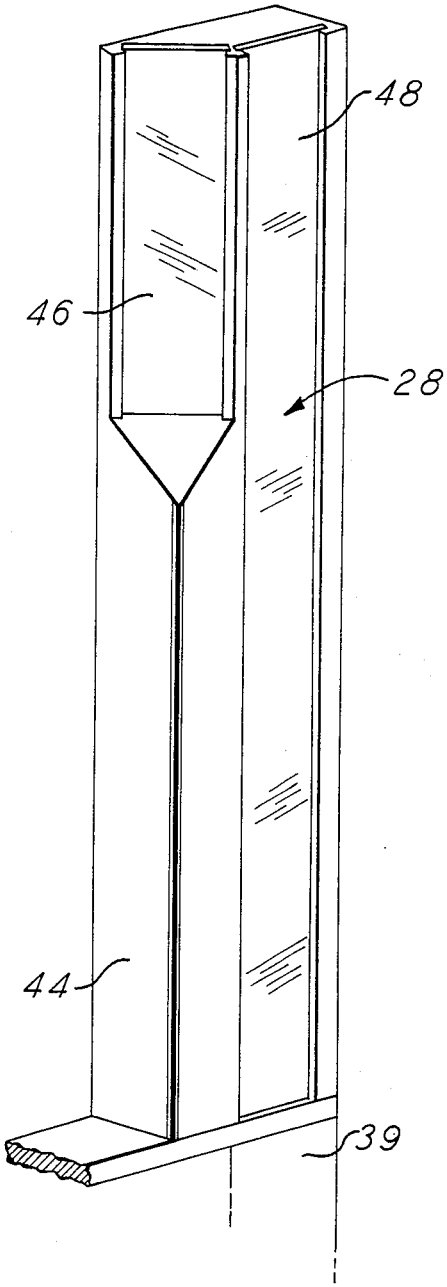
FIG. 2 is an enlarged perspective view, partly broken away, showing a traffic sensor housing of the traffic responsive control system.
Figure 3:
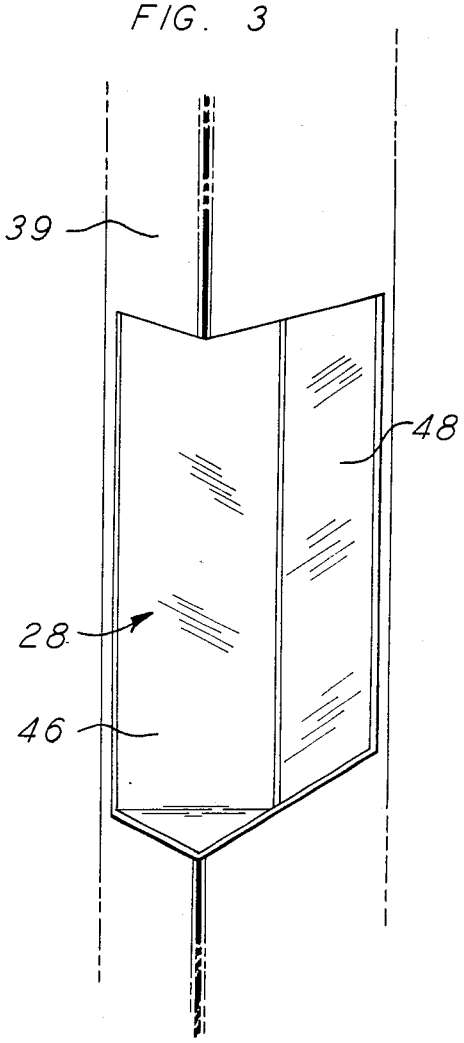
FIG. 3 is an enlarged perspective view, partly broken away, showing an alternative embodiment of a traffic sensor housing.

In order to help reduce or prevent interference by the sun and other sources of ambient infrared radiant energy and to help avoid sensing the door 12, doorjambs 39, 40 and doorway exit rails 68 (FIG. 1), the axes of the receivers 36 and transmitters 34 of the safety and operate sensors 28, 29, 31 are angled, for example 5 degrees, downwardly from the horizontal and the axes of the threshold receiver 36 and transmitter 34 are angled, for example 10 degrees, downwardly from the horizontal. The transmitters 34 of all of the sensors 28–31 are mounted approximately the same distance from the floor, for example approximately twenty-four inches from the floor depending on the installation. Also, with the transmitters 34 mounted approximately twenty-four inches from the floor, the vertical height of the sensor coverage zone, at its maximum, extends from approximately twelve inches from the floor to approximately twenty-four inches from the floor. Accordingly, the sensors 28–31 will not sense either the floor or relatively small objects on the floor. Also, as hereinafter described, the transmitters 34 of the pivot and leading edge safety sensors 28, 29 are selectively deactivated in accordance with the pivotal position of the door 12 to avoid sensing the presence of the door as it pivots between its open and closed positions.

Figure 9B:
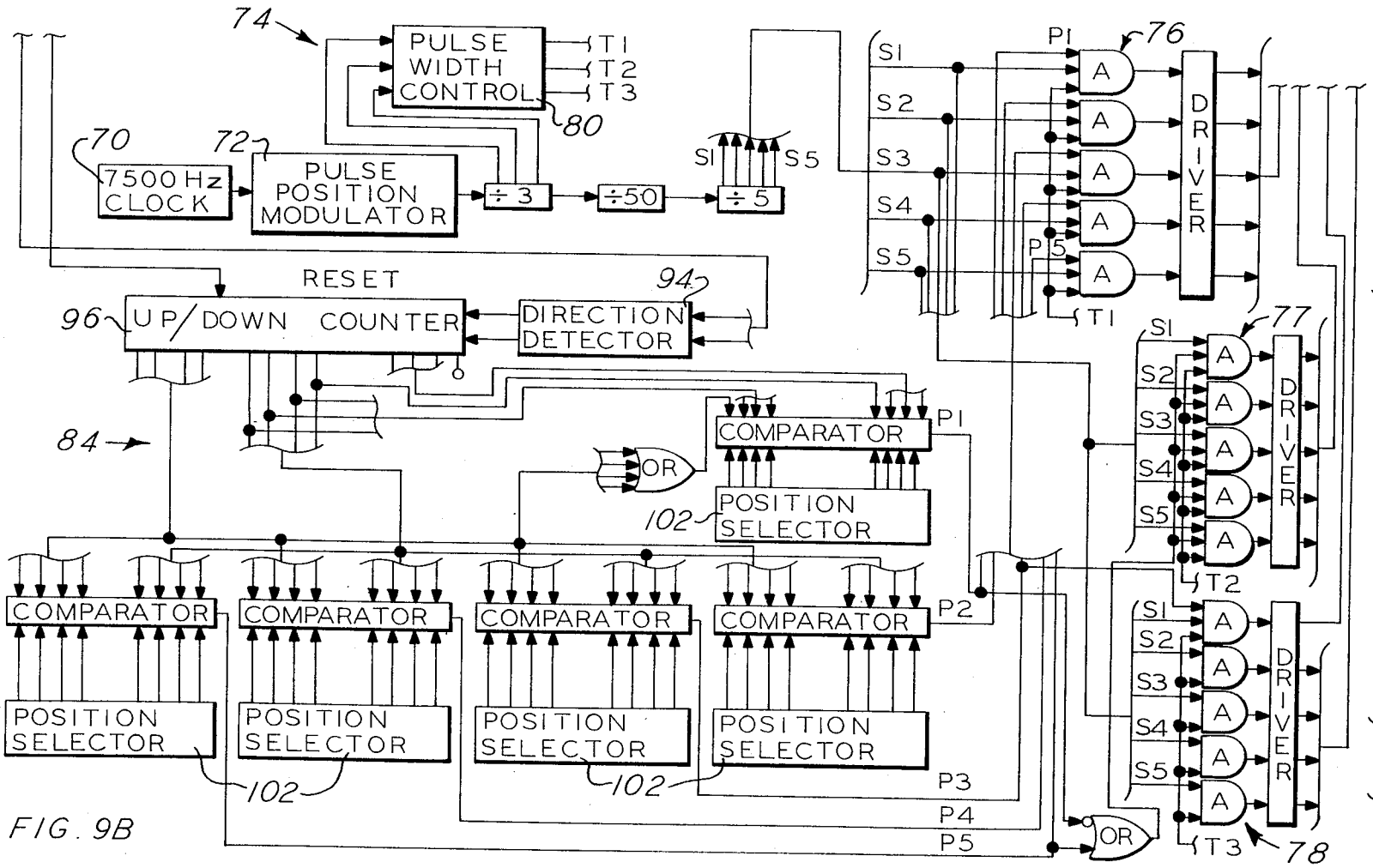

Referring to FIGS. 9A and 9B, a 7,500 Hz. oscillator or clock 70 is provided for pulsing the fifteen transmitters 34 in a predetermined sequence and with each transmitter being pulsed fifty times at 2500 Hz. during each pulsing cycle. A suitable pulse position modulator 72 is employed for encoding the train of pulses from the 7500 Hz. clock 70. The pulse position modulator 72 provides a repeating six pulse code having a selected coded arrangement of relatively short and long intervals between the six pulses. The modulator has a suitable code selector (not separately shown) which is used to select any one of thirty-two different pulse interval codes. The modulator output is connected to a signal generating circuit 74 to generate three timing signals T1, T2 and T3 in succession (individually at an average frequency of 2500 Hz. and collectively at an average frequency of 7500 Hz.) and five transmitter select signals S1–S5 in succession (individually at an average frequency of 10 Hz. and collectively at an average frequency of 50 Hz.).

Three banks 76–78 of five control gates each are provided for controlling the operation of the fifteen LED transmitters 34. One bank 76 of five control gates is employed for controlling the operation of the bank of five pivot safety sensor transmitters 34. Another bank 77 of five control gates is employed for controlling the bank of five leading edge safety sensor transmitters 34 and another bank 78 of five control gates is employed for controlling the bank of five transmitters consisting of the single threshold transmitter 34 and the four operate sensor transmitters 34. The five transmitter select signals S1–S5 are employed for sequentially selecting the five transmitters 34 of each bank of transmitters, and the three timing signals T1–T3 are employed for selecting the three banks of transmitters in succession. Thus, for example during the relatively long interval of the transmitter select signal S1, the three corresponding transmitters 34 of the three transmitter banks are individually energized in sequence through a cycle of fifty pulses each. During each succeeding transmitter select signal S2–S5, another corresponding set of three transmitters are energized in sequence through a cycle of fifty pulses each. The threshold transmitter 34 is energized during the select signal S1. During the remaining select signals S2–S5, the four transmitters 34 of the operate sensor 31 are energized respectively. Thus, during each select signal S2–S5, three transmitters, consisting of a transmitter of each of the operate and two safety sensors, are pulsed in sequence at the timing signal frequency of 7500 Hz., and therefore the areas covered by those three sensors are being looked at substantially simultaneously to sense the presence of any traffic passing along a path of travel through the doorway.

A relatively high transmitter drive voltage is used to produce the required sensor range of up to four to seven feet. For that reason, a pulse width control circuit 80 is provided to establish a narrow timing signal pulse width of approximately twenty microseconds for pulsing each LED infrared transmitter 34 a corresponding short time interval and thereby assure that the transmitters have a long useful life with the high drive voltage.

A selector circuit 84 is provided for selectively activating and deactivating the transmitters 34 of the threshold and safety sensors 28–30 in accordance with the pivotal position of the swinging door 12. For that purpose a suitable rotary pulse generator or digital encoder 86 (FIG. 9A) is provided for determining the exact pivotal position of the door 12. The encoder 86 employs a pair of angularly (67½ degree) spaced retroreflective sensors 88 and a rotor 90 driven by the power operator motor 18 having four equiangularly (90 degree) spaced axially extending reflector vanes 92, each having a circumferential width of 45 degrees. Each sensor 88 comprises an LED transmitter (not separately shown) and a phototransistor receiver (not separately shown) and generates four pulses for each 360 degrees of rotation of the rotor 90. The two sensors 88 provide two output signals in quadrature for determining the direction of rotation of the rotor (and therefore also the direction of pivotal movement of the door 12) with a suitable direction detection circuit 94. A bidirectional or up/down counter 96 is indexed upwardly as the door swings open (i.e. as the motor 18 rotates in one direction) and downwardly as the door swings closed (i.e. as the motor 18 rotates in the opposite direction). The count of the counter 96 therefor reflects the pivotal position of the door. A suitable reset circuit 98 is provided for periodically resetting the door position counter 96 to "0" to assure counter accuracy. The reset circuit 98 is operated by a switch 100 controlled by the door drive shaft 16 to reset the counter 96 when the door reaches its "0" or fully closed position. Alternatively, a magnetic switch in the door jamb is used. The reset circuit 98 also resets the counter 96 when the power to the sensor system goes on.

Five door position selectors 102, each having a bank of selector switches (not separately shown) are provided for selecting five distinct positions of the pivotal door between its fully closed position and fully open position. A comparator is provided for each of the door position selectors 102 for comparing the count of the up/down counter 96 with the count selected by the corresponding door position selector 102. When the count of the up/down counter 96 is greater than the selected count, a signal is generated by the corresponding comparator indicating that the door 12 is open beyond the selected position. As the door 12 is opened, when the door swings past the first selected position, all of the transmitters 34 of the leading edge safety sensor 29 are deactivated. Those transmitters 34 are then reactivated after the door 12 swings past the fifth or last selected position (when the door is nearly fully open) to provide full sensor coverage of the exit area. After the door 12 is opened past the third or middle selected position, the threshold transmitter 34 is activated. Accordingly, the threshold transmitter is activated after the swinging door has been open sufficiently to permit the threshold sensor to transmit through the doorway opening.

Each control gate of the bank 76 of five control gates for the pivot sensor transmitters 34 are connected so that those transmitters are deactivated in sequence as the door 12 is opened. Thus, the pivot sensor transmitter 34 having a beam axis closest to the door opening is deactivated after the door 12 swings past the first selected position, the transmitter 34 having the next closest beam axis is deactivated after the door 12 swings past the second selected position and so forth until the last transmitter 34 having a beam axis furthest from the door opening is deactivated after the door swings past the fifth selected position. Those pivot safety sensor transmitters 34 remain deactive until the door reaches the respective door positions as the door 12 is closed. Likewise, as the door 12 is closed the threshold transmitter 34 is deactivated when the door reaches the third selected position, and the leading edge safety sensor transmitters 34 are deactivated when the door 12 reaches its fifth selected position and are reactivated when the door reaches its first selected position. Thus, the transmitters 34 of the threshold sensor 30 and the pivot and leading edge safety sensors 28, 29 are selectively deactivated and reactivated as the door pivots in both the opening and closing directions to provide for appropriate sensor coverage of the threshold and the safety area on the exit side of the doorway opening and yet to avoid sensing the door as it swings through that safety area.

The five selected door positions are preferably selected at the following opening angles of the door 12. The first position is established at approximately 0.15 degrees (i.e. at a binary count of two of the up/down counter 96 and therefore as soon as the opening movement of the door 12 is ascertained). The second door position is set at approximately 21 degrees; the third position is set at approximately 39 degrees; the fourth position is set at approximately 53 degrees and the fifth position is set at approximately 67 degrees of the door 12. The first door position selector 102 is preferably hard wired to establish the first door position, and the four most significant binary bits of the second door position selector 102 are preferably hard wired at binary 0. Also, the second, third, fourth and fifth angular positions of the door are preferably the same for all door installations and are manually selected with the four corresponding position selectors 102 in accordance with each door installation and the count of the up/-down counter 96 at each of those four selected angular positions of the door 12. In that regard, the count of the door position counter 96 at each door position will be dependent on whether the power operator 14 is header mounted as shown in FIG. 9A or surface mounted, and if surface mounted, the direction the door opens in relationship to the surface mounted operator 14. For example, if the power operator 14 is header mounted as shown in FIG. 9A, the power operator drive motor 18 will typically rotate approximately 39 revolutions for a full 90 degree swing of the door. If the power operator 14 is surface mounted, the motor 18 will typically rotate either approximately 61 revolutions or 30 revolutions, depending on the opening direction of the door relative to the power operator 14, for a full 90 degree swing of the door. Accordingly, the count of the up/down door position counter 96 for each of the last four angular positions of the door and may vary considerably with the door installation and whereby the four door position selectors 102 for the last four door positions are manually set in accordance with each door installation.

In lieu of providing an encoder 86 driven by the power operator motor 18, a suitable rotary potentiometer (not shown) or other rotary encoder (not shown) could be mounted for example on the doorjamb 39 adjacent the pivot edge of the door 12 and connected to the door 12 to be rotated to generate a signal for determining the door position. If a rotary potentiometer is used, a suitable analog to digital converter (not shown) is also employed to convert the variable voltage output of the potentiometer to a digital signal representing the pivotal position of the door (and which corresponds to the digital readout of the up/down door position counter 96).

Each photodiode receiver 36 of the four sensors 28–31 is connected to a corresponding amplifier 106 to amplify the received signal. When the amplified signal reaches a predetermined threshold level, a pulse is transmitted to a pulse accumulator 107 via a timing control gate 108 which filters out all signals not generated during the interval of operation of the transmitter(s) 34 of the corresponding sensor 28–31. Accordingly, the filter gate 108 employed for each receiver 36 will filter out any signals received from the transmitters of the other three sensors.

The four pulse accumulators 107 preferably are identical and accordingly for simplicity, the circuit of only one of the accumulators 107 is diagrammatically illustrated. As shown, the pulse accumulator 107 comprises a pair of pulse counters—a first receiver pulse counter 110 which is indexed by each receiver pulse transmitted via the filter gate 108 and a second transmitter pulse counter 112 which is indexed by each corresponding sensor timing pulse. Thus, the transmitter pulse counter 112 of the leading edge safety sensor accumulator 107 is indexed by each timing pulse T2, i.e. each time one of the corresponding leading edge safety sensor transmitters 34 is pulsed. Similarly, the transmitter pulse counter for the pivot safety sensor 28 is indexed by each timing pulse T1; the transmitter pulse counter for the threshold sensor 30 is indexed by each timing pulse T3 which occurs during the transmitter select signal S1; and the transmitter pulse counter for the operate sensor 31 is indexed by each timing pulse T3 which occurs during each of the remaining transmitter select signals S2–S5. Accordingly, each transmitter pulse counter 112 is indexed to count the maximum number of transmitter pulses which may be received by the corresponding receiver 36.

The transmitter pulse counter 112 resets itself and also the respective receiver pulse counter 110 at the end of each cycle of nine transmitter pulses. If during that nine count cycle, the corresponding receiver 36 has received at least eight of the transmitted pulses (as determined by the receiver pulse counter 110 being indexed to a count of eight), a presence signal will be generated by the receiver pulse counter 110. Thus, for each sensor 28–31, during each cycle of nine transmitter pulses of that sensor, at least eight of the transmitter pulses must be reflected back to the respective receiver 36 to generate a presence signal (which represents that traffic or an object is sensed by the sensor). Accordingly, and since the timing signals T1–T3 are encoded as previously described, it is very unlikely that a presence signal will be generated by the sun or other external source of ambient radiant energy.

Each of the four pulse accumulators 107 is connected via suitable delay and driver circuits to operate the indicator light 38 of the corresponding sensor to indicate when the sensor senses traffic 38, etc. within its coverage zone. Therefore, the indicator lights 38 are useful in determining the proper operation of each sensor 28–31 when installing the sensor, positioning each sensor mounting block 54, masking as desired a part of the sensor filters 46, 48 to reduce the sensor coverage area, and fine tuning each sensor by adjusting the transmitter drive voltage to adjust the sensor coverage zone. Also, the pulse accumulators 107 for the threshold and leading edge and pivot safety sensors 28–30 are connected via an OR gate and suitable delay and driver circuits to generate a "Safety" signal for operation of the motor control circuit 20 for the power operator 14. Similarly, the pulse accumulator 107 for the operate sensor 31 is connected via suitable delay and driver circuits to generate an "Operate" signal for operating the motor control circuit 20. As previously described, the "Safety" and "Operate" signals control the opening and closing movement of the swinging door 12. The delay circuits for the indicator lights 38 provide for increasing the signal width to approximately one-tenth second to maintain the LED indicator lights energized between presence signal pulses. The delay circuits for the "Safety" and "Operate" signals provide for increasing the signal width to approximately one-half second to provide smooth door control.

It is contemplated that the described safety sensor subsystem (which includes the threshold sensor 30 and the pivot and leading edge safety sensors 28, 29) could be employed with an operate sensor subsystem which is different than that described. For example, the operate sensor could be provided by a commercially available microwave motion sensor for sensing motion in the entrance area to the swinging door. It will also be apparent to persons skilled in the art, that various other modifications, adaptations and variations of the foregoing specific disclosure can be made without departing from the teachings of the present invention.

We claim:

1. In an automatic door installation having a swinging door, a power operator for swinging the door between a closed position thereof closing a doorway opening and an open position thereof on a swing side of the doorway, and a traffic responsive control system comprising radiant energy emitter and receiver means for sensing traffic along a path of travel through the doorway opening, and door control means operated by the traffic sensing means to automatically open the door for traffic to pass along said path of travel through the doorway opening, the improvement wherein the traffic sensing means comprises at least one multiple emitter sensor having a bank of a plurality of radiant energy emitters for emitting radiant energy beams having axes angularly spaced along the said traffic path of travel and collectively providing an emitted energy coverage area intersecting the said traffic path of travel and radiant energy receiver means mounted adjacent the bank of emitters for receiving reflected radiant energy emitted from the bank of emitters, the said one multiple emitter sensor being a swing side sensor mounted adjacent one side of the doorway opening to provide a said coverage area on the swing side of the doorway which intersects the path of travel of the swinging door as it is swung between its said closed and open positions, and wherein the traffic responsive control system further comprises door position responsive means for selectively deactivating and reactivating the emitters of the said swing side sensor to avoid sensing the door as it swung between its said closed and open positions.

2. An automatic door installation according to claim 1 wherein the traffic sensing means comprises another said multiple emitter sensor mounted adjacent the other side of the doorway opening from said one multiple emitter sensor and providing a second swing side sensor with a said coverage area on the swing side of the doorway which intersects the said path of travel of the swinging door, and wherein the door position responsive means selectively deactivates and reactivates the emitters of the said second swing side sensor to avoid sensing the door as it is swung between its said closed and open positions.

3. An automatic door installation according to claim 1 wherein the swing side sensor is mounted adjacent the side of the doorway opening at the free end of the swinging door and wherein the door position responsive means activates the emitters of the swing side sensor in both the said closed and open positions of the door and deactivates those emitters as the door is swung between its said closed and open positions.

4. An automatic door installation according to claim 1 wherein the swing side sensor is mounted adjacent the side of the doorway opening at the pivot end of the swinging door and wherein the door position responsive means activates the emitters of the swing side sensor in the said closed position of the door and deactivates those emitters in succession as the door is swung from its said closed position to its said open position and so that the active emitters provide a said coverage area at the back of the swinging door.

5. An automatic door installation according to claim 1 wherein the traffic sensing means comprises another said multiple emitter sensor mounted adjacent one side of the doorway opening and providing a non-swing-side sensor with a said coverage area intersecting the said traffic path of travel on the opposite side of the doorway from the said swing side of the doorway.

6. An automatic door installation according to claim 1 wherein the traffic sensing means comprises a threshold sensor mounted adjacent one side of the doorway opening and having at least one emitter for emitting a radiant energy beam which extends through the doorway opening and radiant energy receiver means mounted adjacent the said one emitter for receiving reflected radiant energy emitted from each emitter of the threshold sensor.

7. An automatic door installation according to claim 1 wherein the traffic sensing means comprises another said multiple emitter sensor mounted adjacent the other side of the doorway opening from the said one multiple emitter sensor and providing a second swing side sensor with a said coverage area on the swing side of the doorway which intersects the said path of travel of the swinging door, another said multiple emitter sensor mounted adjacent one side of the doorway opening and providing a non-swing-side sensor with a said coverage area which intersects the said traffic path of travel on the opposite side of the doorway from the said swing side of the doorway, and wherein the door position responsive means selectively deactivates and reactivates the emitters of the said second swing side sensor to avoid sensing the door as it is swung between its said closed and open positions.

8. An automatic door installation according to claim 1 wherein the traffic responsive means comprises another said multiple emitter sensor mounted adjacent the other side of the doorway opening from the said one multiple emitter sensor and providing a second swing side sensor with a said coverage area on the said swing side of the doorway which intersects the said path of travel of the swinging door, another said multiple emitter sensor mounted adjacent one side of the doorway opening and providing a non-swing-side sensor with a said coverage area which intersects the said traffic path of travel on the opposite side of the door from the said swing side of the doorway, and a threshold sensor mounted adjacent one side of the doorway opening and having at least one emitter for emitting a radiant energy beam which extends through the doorway opening and radiant energy receiver means mounted adjacent the said one emitter for receiving reflected radiant energy emitted from each emitter of the threshold sensor, and wherein the door position responsive means selectively deactivates and reactivates the emitters of the said second swing side sensor and threshold sensor to avoid sensing the door as it swung between its closed and open positions.

9. An automatic door installation according to claim 1 wherein the door position responsive means comprises door position selector means establishing a plurality of different selected angular positions of the swinging door between its closed and open positions and operable for generating a plurality of door position signals at said plurality of different angular positions respectively for said deactivation and reactivation of the emitters.

10. An automatic door installation according to claim 1 wherein each emitter is an LED emitter and wherein each said sensor comprises an elongated support bore for each LED emitter thereof which receives the LED emitter and provides a radiant energy transmission tunnel for transmitting the radiant energy emission beam from the emitter and which limits the effective angle of divergence of the transmitted beam.

11. An automatic door installation according to claim 10 wherein said transmission tunnel limits the effective angle of divergence of the transmitted beam to approximately 20 degrees.

12. An automatic door installation according to claim 1 wherein the power operator comprises a rotary motor for opening the door and wherein the door position responsive means comprises a rotary pulse generator connected to be rotated with the rotary motor for generating a pulse for each predetermined increment of rotation of the motor.

13. An automatic door installation according to claim 12 wherein the rotary pulse generator comprises a rotor with a plurality of equiangularly spaced reflectors and connected to be rotated with the rotary motor and at least one retroreflective pickup which cooperates with the reflectors for generating a pulse train having a pulse for each predetermined increment of rotation of the pulse generator rotor.

14. An automatic door installation according to claim 13 wherein the rotary motor rotates in opposite angular directions thereof as the door is swung in opposite directions thereof respectively between its said closed and open positions and wherein the rotary pulse generator comprises two of said retroreflective pickups angularly positoned for generating two of said pulse trains in quadrature for determining the direction of movement of the swinging door.

15. An automatic door installation according to claim 1 wherein the traffic sensing means comprises sensor operating means for individually pulsing the emitters of all of said sensors in a predetermined sequence.

16. An automatic door installation according to claim 1 wherein the traffic sensing means comprises sensor operating means for individually pulsing the emitters of all of said sensors in a predetermined sequence for emitting radiant energy pulses therewith in a predetermined sequence and for selectively activating the radiant energy receiver means of each said sensor to receive reflected radiant energy pulses from each emitter of the respective sensor only.

17. An automatic door installation according to claim 1 wherein the traffic sensing means comprises sensor operating means for individually pulsing the emitters for emitting radiant energy pulses and presence signal generating means for each sensor for separately accumulating the number of radiant energy pulses emitted by the respective sensor and the number of pulses received by the respective receiver means and for transmitting a presence signal for operating the door control means when there is a predetermined accumulated number of received pulses during a predetermined number of emitted pulses.

18. An automatic door installation according to claim 1 wherein the said angular spacing of the axes of the radiant energy emission beams of each said multiple emitter sensor is substantially constant.

19. An automatic door installation according to claim 18 wherein said angular spacing is approximately 15 degrees.

20. An automatic door installation according to claim 1 wherein each said swing side sensor has a bank of a plurality of five of said radiant energy emitters.

21. An automatic door installation according to claim 5 or 8 wherein the said non-swing-side sensor has a bank of a plurality of four of said radiant energy emitters.

22. An automatic door installation according to claim 1 wherein each emitter is an LED emitter and wherein the traffic sensing means comprises sensor operating means which includes for each sensor, separate voltage regulator means for regulating the emitter drive voltage of the sensor and predetermined resistor means for each LED emitter of the sensor connected between the emitter and the voltage regulator means to establish the relative range of the emitter.

23. An automatic door installation according to claim 22 wherein the sensor operating means further includes means for pulsing the emitters for emitting radiant energy pulses and pulse width control means to establish a predetermined short radiant energy pulse width.

24. An automatic door installation according to claim 1 wherein the traffic sensing means comprises sensor operating means for pulsing the emitters individually in succession for emitting successive radiant energy pulses in accordance with a predetermined encoded pulse spacing.

25. An automatic door installation according to claim 24 wherein the sensor operating means comprises a constant frequency pulse source and a pulse position modulator settable for establishing said predetermined encoded pulse spacing.

26. An automatic door installation according to claim 1 wherein the traffic sensing means comprises sensor operating means for individually and sequentially pulsing the emitters for emitting radiant energy pulses and separate presence signal generating means for each receiver means for transmitting a presence signal for operating the door control means when a predetermined number of pulses are received by the receiver means within a predetermined time interval.

27. An automatic door installation according to claim 1 wherein the traffic sensing means comprises indicator means for each sensor for indicating when a presence signal is generated by the sensor.

* * * * *